US007940190B2

(12) United States Patent
Penney

(10) Patent No.: US 7,940,190 B2
(45) Date of Patent: May 10, 2011

(54) SMOKE DETECTOR

(75) Inventor: Stephen John Penney, Chelmsford (GB)

(73) Assignee: Thorn Security Limited, Sunbury-on-Thames (GB)

( * ) Notice: Subject to any disclaimer, the term of this patent is extended or adjusted under 35 U.S.C. 154(b) by 485 days.

(21) Appl. No.: 11/884,291

(22) PCT Filed: Dec. 12, 2005

(86) PCT No.: PCT/GB2005/004792

§ 371 (c)(1),
(2), (4) Date: Aug. 14, 2007

(87) PCT Pub. No.: WO2006/090099

PCT Pub. Date: Aug. 31, 2006

(65) Prior Publication Data

US 2008/0191888 A1 Aug. 14, 2008

(30) Foreign Application Priority Data

Feb. 22, 2005 (GB) ..... 0503637.1

(51) Int. Cl.
*G08B 17/10* (2006.01)

(52) U.S. Cl. ..... 340/628; 340/630

(58) Field of Classification Search ..... 340/628, 340/630

See application file for complete search history.

(56) References Cited

U.S. PATENT DOCUMENTS

| | | | | |
|---|---|---|---|---|
| 3,932,780 | A * | 1/1976 | DeCaro et al. | 313/113 |
| 3,994,603 | A * | 11/1976 | Paschedag | 356/438 |
| 4,199,755 | A | 4/1980 | Tanaka | |
| 4,306,230 | A | 12/1981 | Forss et al. | |
| 4,488,049 | A | 12/1984 | Marsocci | |
| 4,870,394 | A * | 9/1989 | Corl et al. | 340/630 |
| 5,024,526 | A | 6/1991 | von Redwitz | |
| 6,225,910 | B1 * | 5/2001 | Kadwell et al. | 340/630 |
| 6,737,977 | B2 * | 5/2004 | Nishikawa et al. | 340/628 |
| 2005/0173638 | A1 * | 8/2005 | Powell | 250/341.1 |

FOREIGN PATENT DOCUMENTS

| | | | |
|---|---|---|---|
| GB | 2 314 618 | A | 1/1998 |
| JP | 59046840 | A | 3/1984 |
| JP | 8016953 | A | 1/1996 |

* cited by examiner

*Primary Examiner* — Daniel Wu

*Assistant Examiner* — Mark Rushing

(74) *Attorney, Agent, or Firm* — Brinks Hofer Gilson & Lione

(57) ABSTRACT

A self-monitoring smoke detector comprising a housing (11) defining an internal chamber (12). An optical transmitter (13) is mounted within the housing (11) so as to direct light into the optical chamber (12). An optical receiver (14) is mounted in the housing (11) and in optical communication with the optical chamber (12). The optical transmitter (13) and the optical receiver (14) are so positioned that light from the transmitter cannot directly reach the receiver. Monitoring means is provided, comprising first and second light-scattering means (13*a* and 14*a*) positioned respectively in alignment with the transmitter (13) and the receiver (14). The arrangement is such that, in the absence of reflector particles in the optical chamber, light from the transmitter (13) can reach the receiver (14) only after scattering at the first light-scattering means (13*a*) and then after scattering at the second light-scattering means (14*a*).

19 Claims, 1 Drawing Sheet

SMOKE DETECTOR

This invention relates to a smoke detector, and in particular to a self-monitoring optical point smoke detector.

A known optical point smoke detector is shown schematically in FIG. 1, and includes a light transmitter 1 (such as an infrared LED) and a light receiver 2 (such as a photodiode). The transmitter 1 and the receiver 2 are housed within a chamber 3, with the receiver being positioned off axis from the transmitter. Normally, therefore, light from the transmitter 1 does not impinge upon the receiver 2, as indicated by the arrows 4 which represent the edges of the beam emitted by the transmitter. However, when smoke 5 is present within the chamber 3, it scatters light from the transmitter 1, as indicated by the arrow 6, which then enters the receiver 2 which thereby generates an output signal indicative of smoke detection. This output signal is typically used to generate an alarm, such as a flashing light and/or an audible alarm such as a buzzer or a bell.

Although this known type of optical point smoke detector provides good smoke discrimination, its chamber design requires very tight control of external and internal light reflections to ensure that smoke sampling takes place in a discreetly known volume, to ensure that light transmitted from the transmitter 1 cannot find an alternative path to the receiver 2, and to ensure that external radiation cannot be confused with radiation from the transmitter. Unfortunately, this tight control is such that light only reaches the receiver 2 if scattered by smoke 5, so that the receiver cannot be used to control the emission of a signal to indicate that the detector is in good working order.

One way of ensuring that the receiver can emit such a signal is to introduce a percentage of optical bleed into the chamber 3, that is to say to direct a small proportion of the light emitted by the transmitter 1 towards the receiver 2, so that the receiver will emit a small output signal even when no smoke is present, thereby indicating that the detector is in good working order. Known ways of introducing optical bleed include tinting the color of the chamber walls (either locally or generally), or introducing special plastic features, mirrors or optical fibres. Unfortunately, all the previous approaches have a number of disadvantages, the main ones being extra cost if additional elements are introduced, and of ensuring accurate control of the amount of optical bleed.

The present invention provides a self-monitoring smoke detector comprising a housing defining an internal chamber, an optical transmitter mounted within the housing so as to direct light into the optical chamber, an optical receiver mounted in the housing and in optical communication with the optical chamber, the optical transmitter and the optical receiver being so positioned that light from the transmitter cannot directly reach the receiver, monitoring means comprising first and second light-scattering means positioned respectively in alignment with the transmitter and the receiver, the arrangement being such that, in the absence of reflector particles in the optical chamber, light from the transmitter can reach the receiver only after scattering at the first light-scattering means and then after scattering at the second light-scattering means.

In a preferred embodiment, the housing is cup-shaped to define a cup-shaped optical chamber having a circular cross-section. Advantageously, the first light-scattering means is positioned adjacent to the receiver.

Preferably, the cup-shaped housing is open at one end, and the detector is further provided with a cover overlying said one end in such a manner as to permit smoke to enter the optical chamber, but to prevent light entering the optical chamber, from the exterior of the housing. Conveniently, the cover is cup-shaped, and is detachably connected to the housing to define a lattice therebetween, the lattice permitting smoke to enter the optical chamber, but to prevent light entering the optical chamber, from the exterior of the housing.

Advantageously, the cup-shaped housing is open at the other end thereof, and a second cover plate is provided for covering said other end to prevent smoke and light entering the optical chamber from the exterior of the housing.

Preferably, each of the light-scattering means is constituted by a respective specular reflective surface. Each of the specular reflective surfaces may be a metallic specular reflective surface. Advantageously, each of the light-scattering means is formed on the internal wall of the housing.

In a preferred embodiment, a further metallic specular reflective surface is provided for electromagnetically screening the receiver. Preferably, the further metallic specular reflective surface is formed on that portion of the internal wall of the housing surrounding the receiver.

Conveniently, each of the specular reflective surfaces is formed by a respective metallized conductive coating formed on a respective textured portion of the internal wall of the housing. Alternatively, each of the specular reflective surfaces is constituted by a coating incorporating fine grains of metal or other granular medium.

The invention will now be described in greater detail, by way of example, with reference to the drawings, in which.

Figure 3:
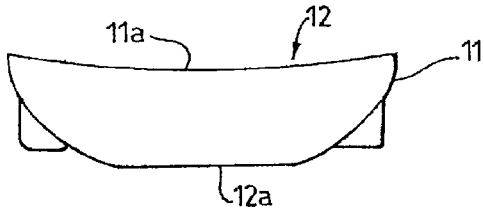
FIG. 3 is a side elevation of the detector of FIG. 1.

Referring to the drawings, FIG. 3 shows an optical point smoke detector having a cup-shaped housing 11 defining an internal, central optical chamber 12. Respective covers (not shown) are provided to cover the top of the housing 11 and the aperture 12*a* formed in the housing at the base of the optical chamber 12. The cover at the base is cup-shaped so as to cover the aperture 12*a* and the side walls of the housing 11. This cover is detachably fixed to the housing 11 in such a manner as to define a lattice structure therebetween which permits the passage of smoke but constitutes an optical labyrinth to prevent the entry of extraneous light to provide an optical labyrinth to prevent stray light entry. The detector may be an addressable device capable of communicating its status to remote control equipment, the equipment being capable of performing an analysis of the detector and generating appropriate responses to the signals received from the detector. A failed detector could alternatively be precisely identified, for example by flashing differently-colored warning LED or transmitting a coding signal to a maintenance engineer equipped with a matching receiver.

An optical transmitter (an infrared LED) 13 is provided within the housing 11 for emitting an optical beam into the chamber 12, and an optical receiver (a photodiode) 14 is mounted in the housing in an off-axis position relative to the transmitter. A lens 15 is provided in front of the receiver 14 for focusing incoming light from the optical chamber 12 onto the receiver 14.

Figure 1:
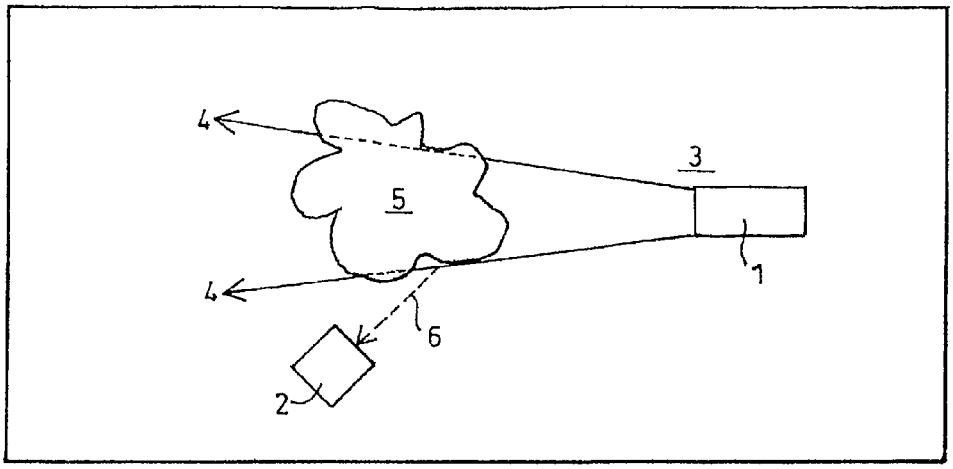
Fig.1. Prior Art
FIG. 1 is a schematic representation of a known optical point smoke detector.
Figure 2:
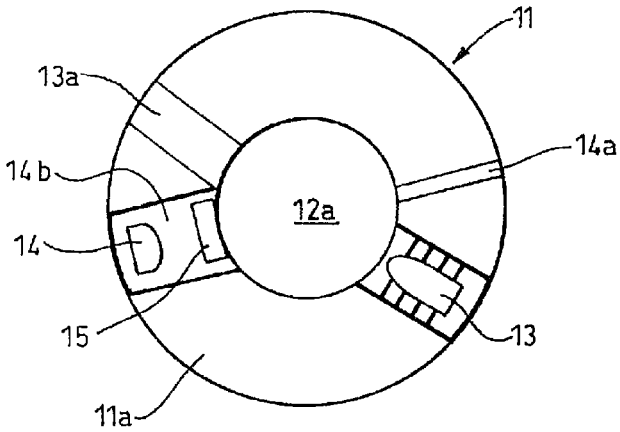
FIG. 2 is a schematic plan view of a smoke detector constructed in accordance with the invention.

The internal wall 11*a* of the housing 11 is also cup-shaped, as is apparent from a comparison of FIGS. 2 and 3. The internal wall 11*a* is formed with two metallic specular reflective surfaces 13*a* and 14*a*, positioned respectively diametrically opposite the transmitter 13 and the receiver 14. A further metallic specular reflective surface 14*b* is formed on the internal surface of the wall 11*a* so as to surround the receiver 14. Each of the specular reflective surfaces 13*a*, 14*a* and 14*b* is formed by accurately coating the relevant portion of the housing wall 11*a* with a metallized conductive means. In particular, the specular reflective surfaces 13*a*, 14*a* and 14*b* are formed by providing the appropriate regions of the internal wall 11*a* with a metal coating which is textured by the incorporation of fine grains of metal. The specular reflective surface is positioned adjacent to the specular reflective surface 14*b*, so that light scattered by the surface 13*a* cannot enter the receiver 14 directly.

In use, in the event of smoke entering the optical chamber 12, light from the transmitter 13 is scattered by smoke particles onto the lens 15, where it is focused onto the receiver 14, which thereby emits a first, high output signal indicative of the presence of smoke. In the absence of smoke in the optical chamber 12, light from the transmitter 13 is scattered from the specular reflective surface 13*a*. Part of the scattered light is further scattered by the specular reflective surface 14*a*. Part of that scattered light will then be incident on the lens 15 to be focused onto the receiver 14, which thereby emits a second, lower output signal which indicates that all parts of the detector are in good working order. This second output signal is considerably smaller than the first output signal, and so is insufficient to be mistaken for a genuine smoke signal.

The two specular reflective surfaces 13*a* and 14*a*, being formed on the internal curved wall 11*a* of the housing 11 are such that light scattered from the surface 13*a* is not directed directly onto the surface 14*a*. This also helps to minimize the light scattered from the surface 14*a* to the receiver 14.

The metallic specular reflective surface 14*b* is provided to act as an electromagnetic screen to protect the receiver 14 from stray radiated electromagnetic fields. The surface 14*b* thus acts as a Faraday shield. The provision of the metallic specular reflective surfaces 13*a*, 14*a* and 14*b* thus solves two problems of prior art detectors, the metallic surface 14*b* acting as an electromagnetic screen for the receiver 14, and the surfaces 13*a* and 14*a* providing an optical pedestal which will cause the receiver to output a signal which is insufficient to be mistaken for a genuine indication of the presence of smoke, but does indicate that all parts of the detector are in good working order.

The use of the two specular reflective surfaces 13*a* and 14*a* in the particular configuration described above ensures an evenness of scatter within the optical chamber 12 that is less critically dependent on the optical alignment of the internal components that is the case with known detectors.

It will be apparent that modifications could be made to the detector described above. In particular, different forms of optical transmitter and receiver could be used. Moreover, the specular reflective surfaces 13*a*, 14*a* and 14*b* could be implemented in different ways. For example, these surfaces may be formed by providing the appropriate region of the internal wall 11*a* with a rough texture and then coating those regions with a highly reflective metallization. Moreover, as the surface 14*b* is provided for electromagnetic screening of the receiver, it does not need to have light-scattering functionality, so it does not need to be a specular reflective surface.

It will also be apparent that the principle of the invention, namely the use of the two specular reflective surfaces 13*a* and 14*a* for self-monitoring, can be used in smoke detectors of other configurations.

The invention claimed is:

1. A self-monitoring smoke detector comprising:

a housing defining an optical chamber;

an optical transmitter mounted within the housing so as to direct light into the optical chamber;

an optical receiver mounted in the housing and in optical communication with the optical chamber, the optical transmitter and the optical receiver being so positioned that light from the transmitter cannot directly reach the optical receiver, but that in the presence of reflective particles in the optical chamber, light from the transmitter reaches the optical receiver after scattering on the reflective particles, and generates an increased output signal indicative of smoke detection; and first and second light-scattering devices positioned respectively in alignment with the optical transmitter and the optical receiver, the positioning of the first and second light-scattering devices being such that:

in the absence of reflective particles in the optical chamber, a portion of the light from the transmitter can reach the optical receiver only after scattering at the first light-scattering device and then after scattering at the second light-scattering device so that the receiver emits an output signal even when no smoke is present thereby indicating that the detector is operational.

2. A smoke detector as claimed in claim 1, wherein the housing is cup-shaped to define a cup-shaped optical chamber having a circular cross-section.

3. A smoke detector as claimed in claim 1 or claim 2, wherein the first light-scattering device is positioned adjacent to the optical receiver.

4. A smoke detector as claimed in claim 2, wherein the cup-shaped housing is open at one end, and the detector is further provided with a cover overlying said one end in such a manner as to permit smoke to enter the optical chamber, but to prevent light entering the optical chamber, from the exterior of the housing.

5. A smoke detector as claimed in claim 4, wherein the cover is cup-shaped, and is detachably connected to the housing to define a lattice therebetween, the lattice permitting smoke to enter the optical chamber, but to prevent light entering the optical chamber, from the exterior of the housing.

6. A smoke detector as claimed in claim 4 or claim 5, wherein the cup-shaped housing is open at the other end thereof, and a cover plate is provided for covering said other end to prevent smoke and light entering the optical chamber from the exterior of the housing.

7. A smoke detector as claimed in claim 1, wherein each of the light-scattering devices is constituted by a respective reflective surface.

8. A smoke detector as claimed in claim 7, wherein each of the reflective surfaces is a metallic reflective surface.

9. A smoke detector as claimed in claim 8, wherein each of light-scattering devices is formed on an internal wall of the housing.

10. A smoke detector as claimed in anyone of claims 7 to 9, further comprising an electromagnetic screen for a component of the detector.

11. A smoke detector as claimed in claim 10, wherein the electromagnetic screen is metallic.

12. A smoke detector as claimed in claim 11, wherein the electromagnetic screen is a metallic reflective surface.

13. A smoke detector as claimed in claim 12, wherein the optical receiver is said component.

14. A smoke detector as claimed in claim 13, wherein the metallic reflective surface constituting the electromagnetic screen is formed on that portion of the internal wall of the housing surrounding the optical receiver.

15. A smoke detector as claimed in claim 7, wherein each of the reflective surfaces is formed by a respective metallised conductive coating formed on a respective textured portion of the internal wall of the housing.

16. A smoke detector as claimed in claim 7, wherein each of the reflective surfaces is constituted by a coating incorporating fine grains of metal or other granular medium.

17. A smoke detector as claimed in claim 1, wherein the reflective particles comprises smoke particles.

18. A smoke detector as claimed in claim 1, wherein the optical receiver emits a signal, the signal emitted by the optical receiver in the presence of the reflective particles in the optical chamber being higher than the signal emitted by the optical receiver in the absence of the reflective particles.

19. A smoke detector as claimed in claim 1, wherein the positioning of the first and second light-scattering devices is such that:

in the absence of reflective particles in the optical chamber, light from the optical transmitter is incident on the optical receiver at a first level, and in the presence of the reflective particles in the optical chamber, light from the optical transmitter is incident on the optical receiver at a second level, wherein the first level is less than the second level, and wherein the first level is a non-zero level.

* * * * *